US012428108B1

(12) United States Patent
Cusimano

(10) Patent No.: US 12,428,108 B1
(45) Date of Patent: Sep. 30, 2025

(54) SAND ANCHORING KIT FOR WATERCRAFT

(71) Applicant: Barbara Cusimano, Fort Myers, FL (US)

(72) Inventor: Barbara Cusimano, Fort Myers, FL (US)

( * ) Notice: Subject to any disclaimer, the term of this patent is extended or adjusted under 35 U.S.C. 154(b) by 562 days.

(21) Appl. No.: 17/890,733

(22) Filed: Aug. 18, 2022

(51) Int. Cl.

| | |
|---|---|
| ***B63B 21/29*** | (2006.01) |
| ***B63B 21/24*** | (2006.01) |
| ***B63B 34/52*** | (2020.01) |
| ***B63B 35/58*** | (2006.01) |

(52) U.S. Cl.
CPC ..... *B63B 21/29* (2013.01); *B63B 21/24* (2013.01); *B63B 34/52* (2020.02); *B63B 35/58* (2013.01)

(58) Field of Classification Search
CPC ..... B63B 21/24; B63B 21/29; B63B 34/52; B63B 35/58
USPC ..... 114/294, 345; 441/40, 129, 130
See application file for complete search history.

(56) References Cited

U.S. PATENT DOCUMENTS

| | | | | |
|---|---|---|---|---|
| 4,913,672 A * | 4/1990 | Martin | A47C 15/006 114/294 |
| 5,551,901 A | 9/1996 | Jaeger | |
| 5,819,681 A * | 10/1998 | Barnes | B63B 21/29 114/294 |
| 7,882,793 B1 | 2/2011 | Paulus | |
| 2002/0026890 A1* | 3/2002 | Zook | B63B 21/29 114/294 |
| 2015/0232153 A1* | 8/2015 | Beech | B63B 21/48 114/294 |

FOREIGN PATENT DOCUMENTS

| | | | |
|---|---|---|---|
| AT | 5621 U1 * | 9/2002 | B63B 21/29 |
| GB | 2382061 A * | 5/2003 | B63B 21/29 |

* cited by examiner

*Primary Examiner* — Ajay Vasudeva
(74) *Attorney, Agent, or Firm* — Sanchelima & Associates, P.A.; Jesus Sanchelima; Christian Sanchelima

(57) ABSTRACT

A sand anchoring kit for watercraft including a floating raft assembly, a rope assembly, and a bag assembly. The floating raft assembly includes a floating raft. The floating raft can be inflated or deflated. The rope assembly includes a rope. The bag assembly includes a bag. The bag can store the floating raft when deflated and the rope. The bag can be filled with sand and attached to the floating raft through the rope to be used as an anchor. The bag is closed with the sand thereinto. The bag sinks and anchors the floating raft when inflated in a predetermined position in a water body.

1 Claim, 5 Drawing Sheets

SAND ANCHORING KIT FOR WATERCRAFT

II. BACKGROUND OF THE INVENTION

1. Field of the Invention

The present invention relates to a sand anchoring kit for watercraft and, more particularly, to a sand anchoring kit for watercraft that allows to pack the inflatable watercraft into a bag and then use the bag for anchoring the watercraft when inflated.

2. Description of the Related Art

Several designs for anchoring have been designed in the past. None of them, however, include a shovel to fill a bag with sand to anchor a raft.

Applicant believes that a related reference corresponds to U.S. Pat. No. 7,882,793 issued for a lightweight anchor for watercraft which has a fabric ballast container which can be filled with sand or gravel. Applicant believes that another related reference corresponds to U.S. Pat. No. 5,551,901 issued for a buoyant water marker that includes a floating buoy member with an elastic tether and anchoring bag. None of these references, however, teach of a sand anchoring kit for watercraft that is comprised of a floating raft assembly with a tethered bag assembly which contains a small shovel which allows the user to float to shore and fill the bag assembly with sand to create a temporary watercraft anchor on the shore.

Other documents describing the closest subject matter provide for a number of more or less complicated features that fail to solve the problem in an efficient and economical way. None of these patents suggest the novel features of the present invention.

III. SUMMARY OF THE INVENTION

It is one of the objects of the present invention to provide a sand anchoring kit for watercraft that includes a bag which can be filled with sand for anchoring a floating raft.

It is another object of this invention to provide a sand anchoring kit for watercraft that includes a shovel to fill the bag with sand.

It is another object of this invention to provide a sand anchoring kit for watercraft that includes a floating raft which allows a user to float in the sea.

It is still another object of the present invention to provide a sand anchoring kit for watercraft that includes a rope having a buoy which connects the bag with the floating raft, the buoy warns about the presence of the rope.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

IV. BRIEF DESCRIPTION OF THE DRAWINGS

With the above and other related objects in view, the invention consists in the details of construction and combination of parts as will be more fully understood from the following description, when read in conjunction with the accompanying drawings in which:

FIG. 1 represents an isometric operational view of the present invention 10 wherein a user is filling the bag assembly 60 with sand.

FIG. 1A shows an isometric operational view of the present invention 10 wherein a user is over the floating raft assembly 20 in the sea. The floating raft assembly 20 being anchored by means of the bag assembly 60.

Figure 1:
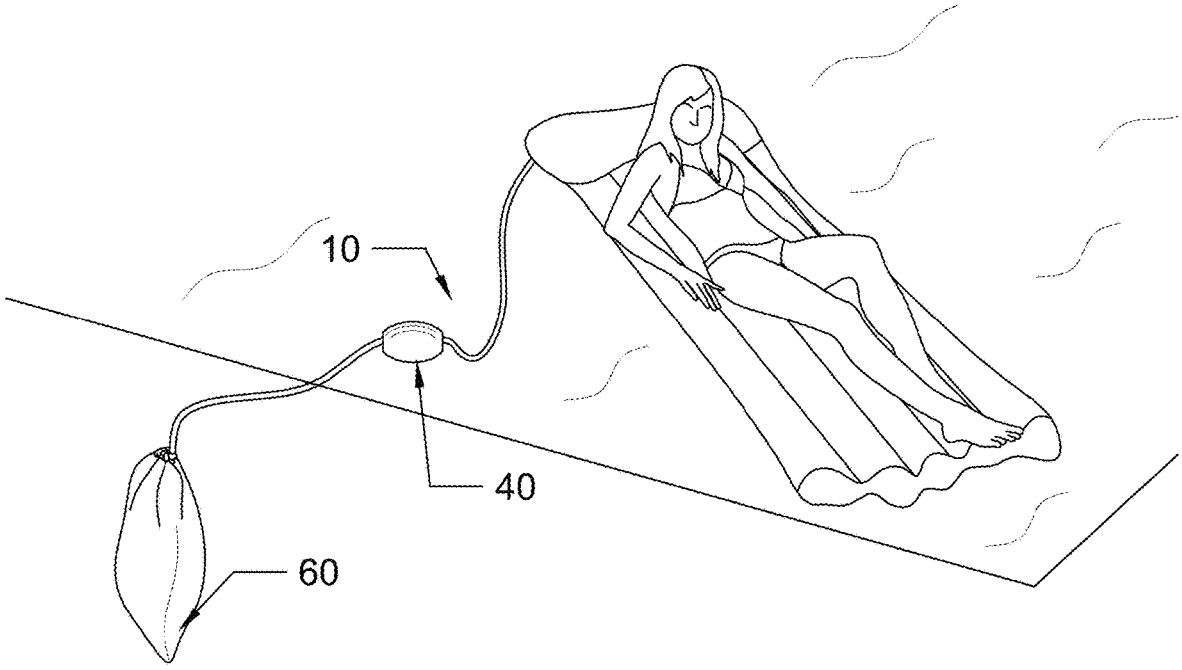
Figure 1A:
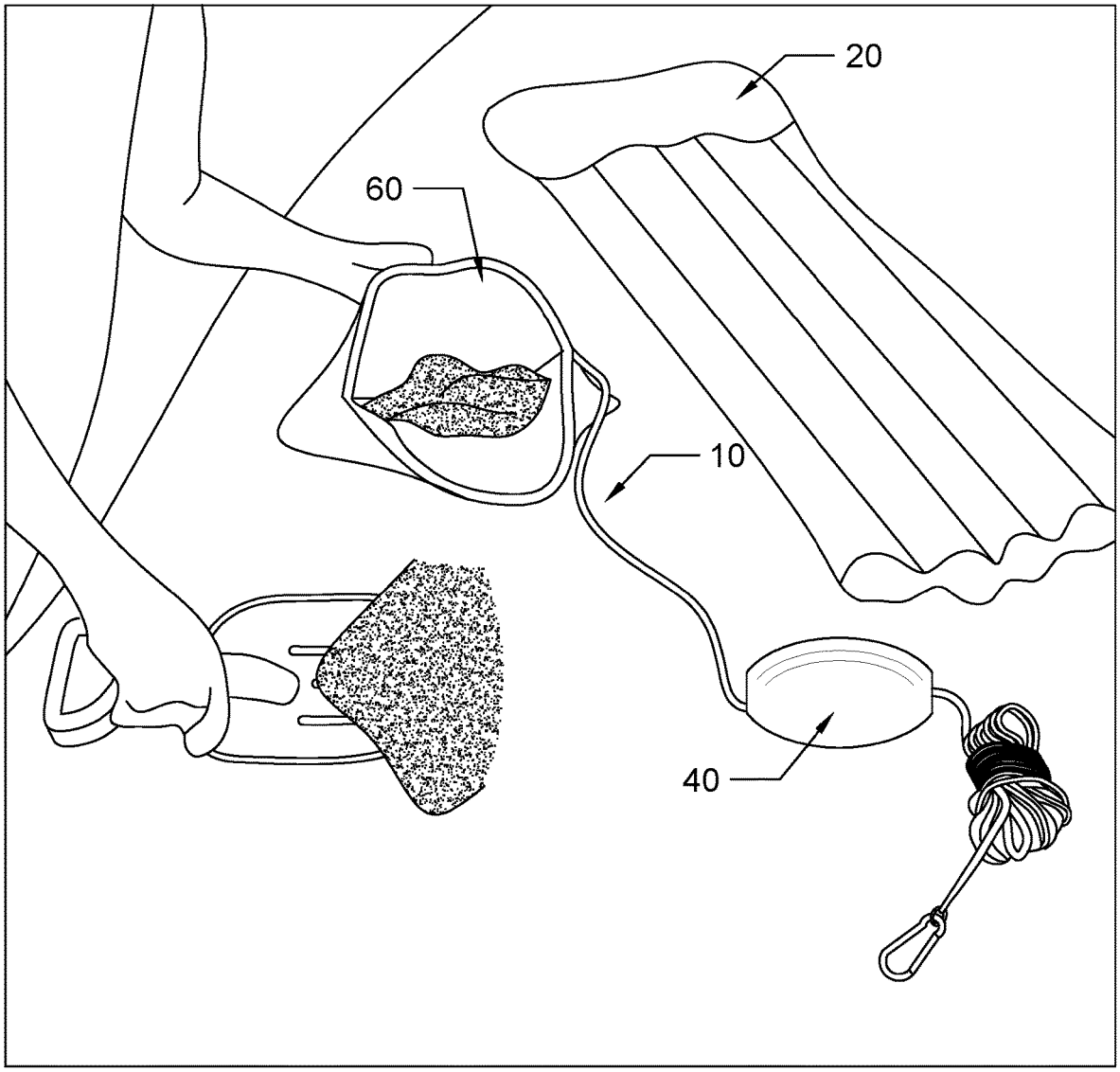
Figure 2:
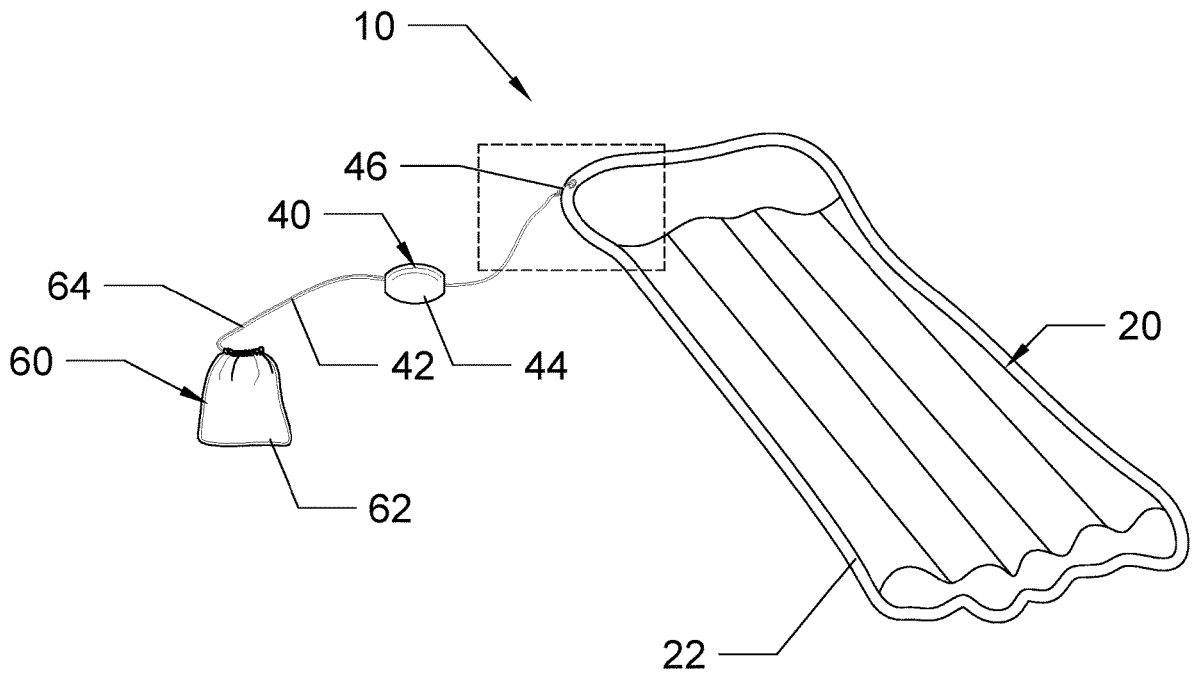
FIG. 2 illustrates an isometric view of the present invention 10 in an expanded configuration.
Figure 2A:
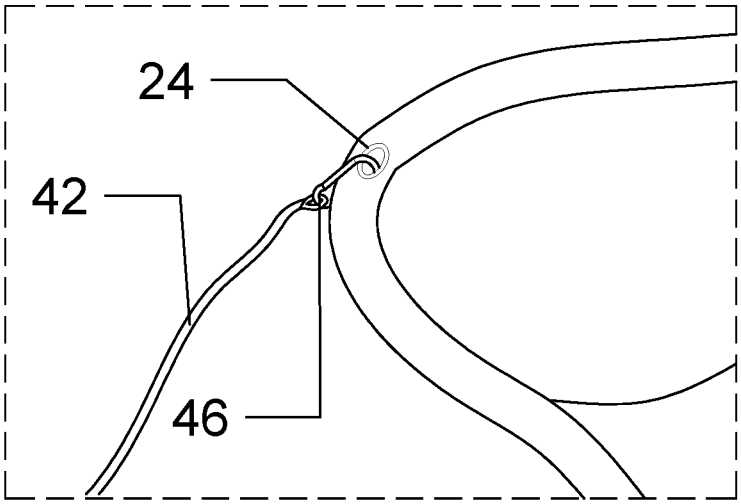
FIG. 2A depicts a broken view of the connecting element 46 connected to the receiving element 24.
Figure 3:
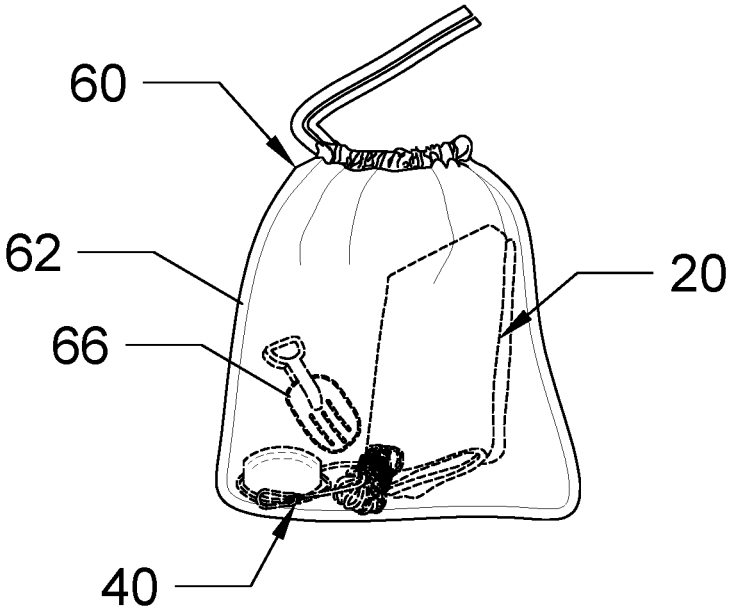

FIG. 3 illustrates a see-through view of the bag assembly 60 in a retracted configuration having the floating raft assembly 20 and the rope assembly 40 thereinto.

Figure 4:
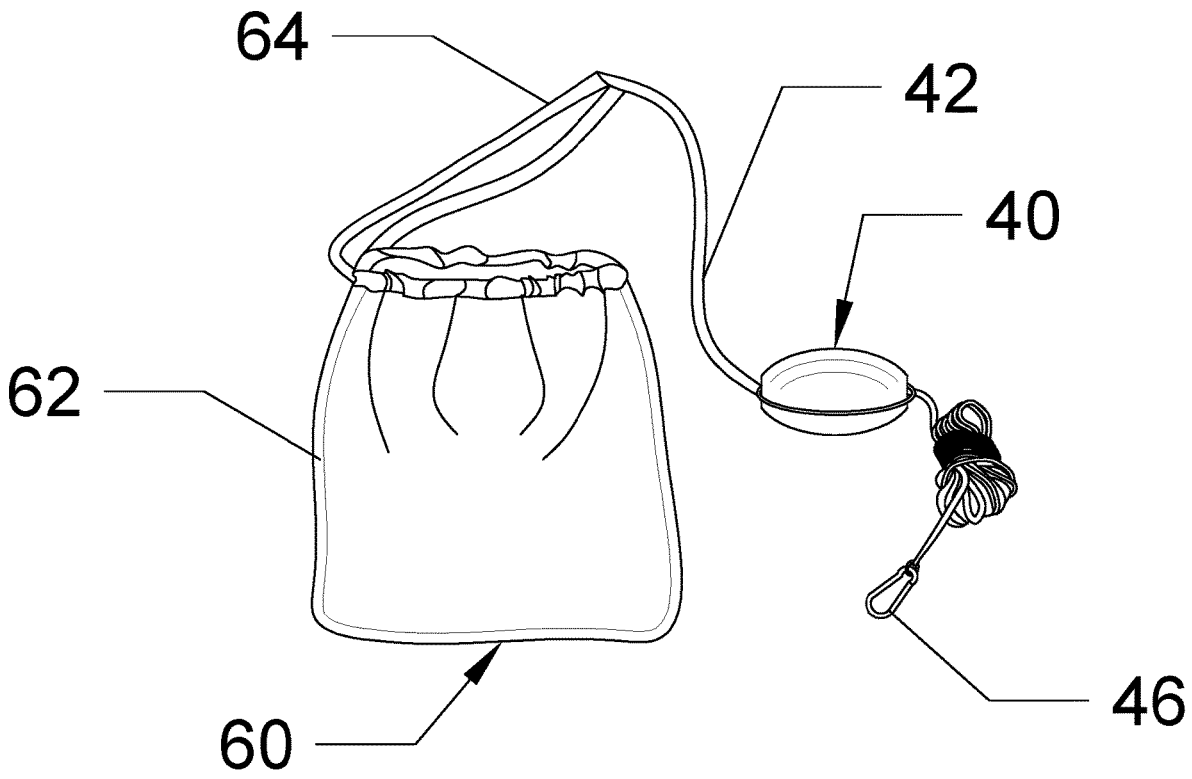

FIG. 4 is a representation of the bag assembly 60 and the rope assembly 40.

V. DETAILED DESCRIPTION OF THE EMBODIMENTS OF THE INVENTION

Referring now to the drawings, where the present invention is generally referred to with numeral 10, it can be observed that it basically includes a floating raft assembly 20, a rope assembly 40, and a bag assembly 60. It should be understood there are modifications and variations of the invention that are too numerous to be listed but that all fit within the scope of the invention. Also, singular words should be read as plural and vice versa and masculine as feminine and vice versa, where appropriate, and alternative embodiments do not necessarily imply that the two are mutually exclusive.

The floating raft assembly 20 may include a floating raft 22 and at least one receiving element 24. The floating raft 22 may have a rectangular shape. It also may be suitable for the floating raft 22 to have a circular shape, a triangular shape, or any other suitable shape. The floating raft 22 may be made of plastic, or any other suitable material. It should be understood that the floating raft 22 may be an enclosing suitable to receive air thereinto. The floating raft 22 may be elastic. The floating raft 22 may be inflated. The floating raft 22 may include a lid to prevent the exit of air from the floating raft 22. When inflated the floating raft 22 may float in the water. As best illustrated in FIG. 3 the floating raft 22 may be folded to be stored into the bag assembly 60. The at least one receiving element 24 may be located in the edges of the floating raft 22. In a preferred embodiment the at least one receiving element 24 may be located in a corner of the floating raft 22. The at least one receiving element 24 may be an eyelet. The receiving element 24 may be made of metal, plastic, or any other suitable material. The receiving element 24 may be used to connect the rope assembly 40 thereto.

The rope assembly 40 may include a rope 42, a buoy 44 and a connecting element 46. The rope 42 may be made of aramid, steel, wire, or any other suitable material. It should be understood that the rope 42 may also be a chain or any other suitable element for connecting the bag assembly 60 with the floating raft assembly 20. The buoy 44 may be located in a middle portion of the rope 42. The buoy 44 may be a floating element. The buoy 44 may be used as a navigation mark to prevent the presence of the rope 42. The buoy 44 may be made of plastic. The buoy 44 may have an oval shape. The buoy 44 may be slidable along the rope 42. The buoy 44 may be colored in bright colors. The buoy 44 may have a reflective layer. The rope 42 may have a first distal end and a second distal end. The first distal end of the rope 42 may have a connecting element 46. The connecting element 46 may be a hook or any other suitable attaching element. The connecting element 46 may be secured to the receiving element 24. The connecting element 46 may be detachable from the receiving element. The connecting element 46 may be made of metal, plastic, or any other suitable material. The second distal end of the rope 42 may be connected to the bag assembly 60.

The bag assembly 60 may include a bag 62, a closing element 64 and a shovel 66. The bag 62 may be made of Nylon, low-density polyethylene (LDPE). It also may be suitable for the bag 62 to be made of polyvinyl chloride (PVC), cloth, or any other suitable material. As best illustrated in FIG. 3 the bag 62 may be suitable to receive the shovel 66, the floating raft assembly 40 and the rope assembly 40. In a preferred embodiment the bag 62 may receive sand, gravel, rice, or any other suitable material that allows adding weight into the bag 62. The walls of the bag 62 may be suitable to allow the exit of the water therethrough. The walls of the bag 62 may retain the sand, gravel, rice, or any other suitable material.

The bag 62 may have a closing element 64. The closing element 64 may be located in the uppermost edges of the bag 62. The uppermost edges of the bag 62 may define a conduit which is retracted to close the bag 62 as illustrated in FIG. 3. The closing element 64 may be a drawstring. The closing element 64 may be made of aramid, steel, wire, or any other suitable material. The closing element 64 may be connected to the rope 42. The shovel 66 may be located inside the bag 62. The shovel 66 may be made of plastic, metal, or any other suitable material. The shovel 66 may have a broad blade and a handle. The shovel 66 may be used to fill bag 62 with sand. The shovel 66 may also be used to remove, throwing loose matter.

In a preferred embodiment the shovel 66, the rope assembly 40 and the floating raft assembly 20 may be stored into the bag 62. Then, the shovel 66, the rope assembly 40 and the floating raft assembly 20 may be taken out from the bag and the floating raft 22 may be inflated. The bag 62 may be filled with sand using shovel 66. Then, the bag 62 may be closed and attached to the floating raft 22. The floating raft 22 may be introduced in the water to float and the bag 62 with sand sink to work as an anchor. It should be understood that the bag assembly 20 may be connected through the rope assembly 40 to any other type of raft to be used as an anchor.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A sand anchoring kit for watercraft, consisting of:

a floating raft assembly, wherein said floating raft assembly includes a floating raft, wherein said floating raft is an inflatable raft, said floating raft has an inflated configuration and a deflated configuration, said floating raft is configured to support the weight of a user, said floating raft includes a receiving element, said receiving element is located in a non-inflatable edge of said floating raft, said receiving element is an eyelet, wherein said receiving element is located at a corner of said floating raft;

a rope assembly, wherein said rope assembly includes a rope, said rope has a buoy, said buoy is located in a central portion of said rope, said rope indicates presence of said rope in the water, said rope has a first distal end and a second distal end, said first distal end has a hook, said hook is detachable engaged to said receiving element, wherein said buoy is slidable along said rope; and a bag assembly, wherein said bag assembly includes a bag, and a shovel, said bag is capable of storing said floating raft in said deflated configuration, said shovel, and said rope therein, wherein said bag is capable of being filled with sand and being attached to said floating raft in said inflated configuration by means of said rope, said bag is filled with sand by means of said shovel, said bag sinks to anchor said floating raft, said bag has a closing element, said closing element is operated to open and close said bag, said closing element is connected to said second distal end of said rope, wherein said shovel has a broad blade and a handle, wherein said bag is made of a material that allows water to exit therethrough while retaining sand.

* * * * *